US005907917A

United States Patent [19]

Bicker

[11] Patent Number: 5,907,917

[45] Date of Patent: Jun. 1, 1999

[54] SHEET MATERIAL DISPLAY PANEL

[76] Inventor: Robert Laurence Bicker, 29 Lyons Avenue, Murrays Bay, Auckland, New Zealand

[21] Appl. No.: 08/956,916

[22] Filed: Oct. 23, 1997

Related U.S. Application Data

[63] Continuation of application No. 08/382,002, filed as application No. PCT/NZ93/00059, Jul. 23, 1993, abandoned.

[51] Int. Cl.[6] ..... G09F 7/00

[52] U.S. Cl. ..... 40/1; 40/539; 40/610; 428/188; 428/186

[58] Field of Search ..... 40/539, 610, 594; 428/56, 120, 182, 186, 188

[56] References Cited

U.S. PATENT DOCUMENTS

| | | | |
|---|---|---|---|
| 2,142,547 | 1/1939 | Anderson | 40/539 |
| 2,148,176 | 2/1939 | Schroeder | 428/186 X |
| 2,518,550 | 8/1950 | Ives | 428/188 X |
| 2,750,668 | 6/1956 | Tarrazi . | |
| 4,507,348 | 3/1985 | Nagata et al. . | |
| 4,578,865 | 4/1986 | Keller . | |
| 4,794,712 | 1/1989 | Wood . | |

FOREIGN PATENT DOCUMENTS

| | | | |
|---|---|---|---|
| 151209 | 4/1953 | Australia . | |
| 224388 | 10/1959 | Australia . | |
| 268812 | 1/1964 | Australia . | |
| 1062992 | 4/1954 | France . | |
| 92877 | 9/1938 | Switzerland | 428/182 |
| 471003 | 5/1969 | Switzerland | 428/186 |
| 1 334 383 | 10/1973 | United Kingdom . | |
| 1 524 799 | 9/1978 | United Kingdom . | |

*Primary Examiner*—Cassandra H. Davis
*Attorney, Agent, or Firm*—Barnes & Thornburg

[57] ABSTRACT

A display and panels include corrugated or fluted sheet material having display and support surfaces in which a plurality of cut-outs or slits are made in one or both surfaces so as to make the material rollable. The plurality of slits are in the same axis as the corrugations or flutes, and may be formed by means of a cutting tool adapted to slit or cut the corrugated or fluted sheet material. A guide can control the one or more blades of the cutting tool into contact with the one or more respective corrugations or flutes.

10 Claims, 4 Drawing Sheets

SHEET MATERIAL DISPLAY PANEL

Figure 1:
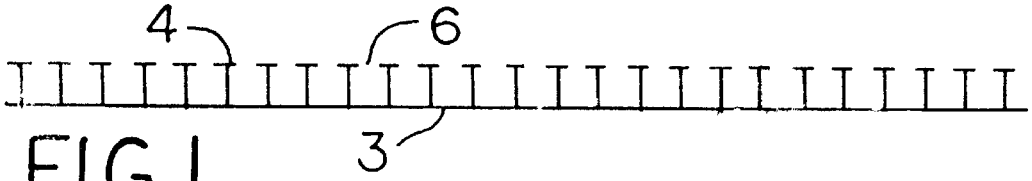

This application is a continuation of application Ser. No. 08/382,002, filed as PCT/NZ93/00059 published as WO/9402926 Feb. 3, 1994 now abandoned.

This invention relates to improvements in displaying means and panels and means of cutting display means and panels therefor and more particularly, but not exclusively to a sheet-type material and cutting tool therefor.

To the present time, various types of display devices and panels have been commercially available but to varying degrees have suffered from the disadvantage of being heavy and cumbersome and difficult to store and transport. In particular, existing display devices and panels may be heavy and require backing to the sheet metal or other inflexible substrate to maintain its rigidity. Furthermore, the frames necessary to house such displays and panels may themselves be heavy and expensive and accordingly difficult to transport and erect. In the case of display devices used in exhibitions and the like, the visual presentation is important and while certain display devices currently available meet certain expectations in the marketplace, the advantages referred to above, make them unwieldy and expensive.

It is thus an object of the present invention to provide a display means or panels and a method for preparing the said display means or panels, which can provide a relatively simple and effective display means and method thereof. In the case of the preferred embodiments, the object of the invention is to achieve a display means which is able to provide in use a substantially rigid surface to carry the necessary display, but which can also be readily transported and stored.

It is a further object of the present invention to provide display means and panels which overcome or at least obviate disadvantages in the display means and panels available at the present time or at least will provide the public with a useful choice.

Further objects of the present invention will become apparent from the following description.

According to one aspect of the present invention, there is provided a display means comprising corrugated or fluted sheet material having a display surface and a support surface, wherein one or both surfaces have a plurality of cut-outs or slits provided substantially in the same axis as the corrugations or flutes so as to enable said display means to be rollable.

According to a further aspect of the present invention, there is provided a display means comprising corrugated or fluted sheet material having a display surface and a support surface in which one or both surfaces have a plurality of cut-outs or slits provided substantially in the said axis as the corrugations or flutes and wherein an adhesive means is applied to the display surface and thereafter a print or other image substrate is adhered to the display surface.

According to a further aspect of the present invention, there is provided a display means as aforesaid wherein the said support surface has a plurality of cuts or slits in the said surface in the same axis as the corrugation or flutes, so as to reduce the surface tension of the said support surface and render the sheet material non-rigid unless otherwise framed or secured and at such time to provide a substantially planar display surface.

According to a further aspect of the present invention, there is provided a panel means comprising corrugated or fluted sheet material wherein one or both surfaces have a plurality of cut-outs or slits provided substantially in the same axis as the corrugations or flutes so as to enable said panel means to be deformably erected.

According to a further aspect of the present invention, there is provided a cutting tool for slitting or cutting a corrugated or fluted sheet material comprising a guide means, engageable within at least one corrugation or flute, and at least one blade means controllable by said guide means to engage with and slit or cut the or a respective corrugation or flute.

Further aspects of this invention, which should be considered in all its novel aspects, will become apparent from the following description, given by way of example or possible embodiments thereof and in which reference is made to the accompanying drawings.

FIG. 1: shows a cross-sectional end view of a display means according to one possible embodiment of the invention showing a single slit in each corrugation in only one surface of the display means.

Figure 2:
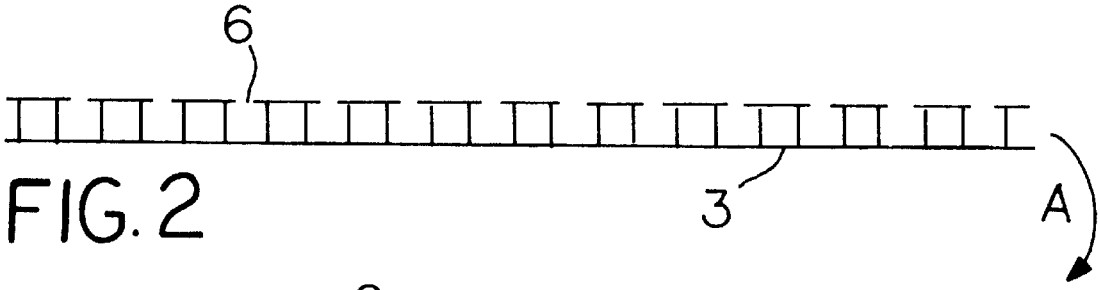

FIG. 2: shows a display means according to FIG. 1 in the same cross-sectional end view wherein channels are cut into every second corrugation or flute in only one surface of the display means.

Figure 3:
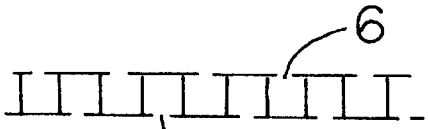

FIG. 3: shows a display means according to FIG. 1 in the same cross-sectional end view wherein channels are cut into every second corrugation or flute on both surfaces of the display medium.

Figure 4:
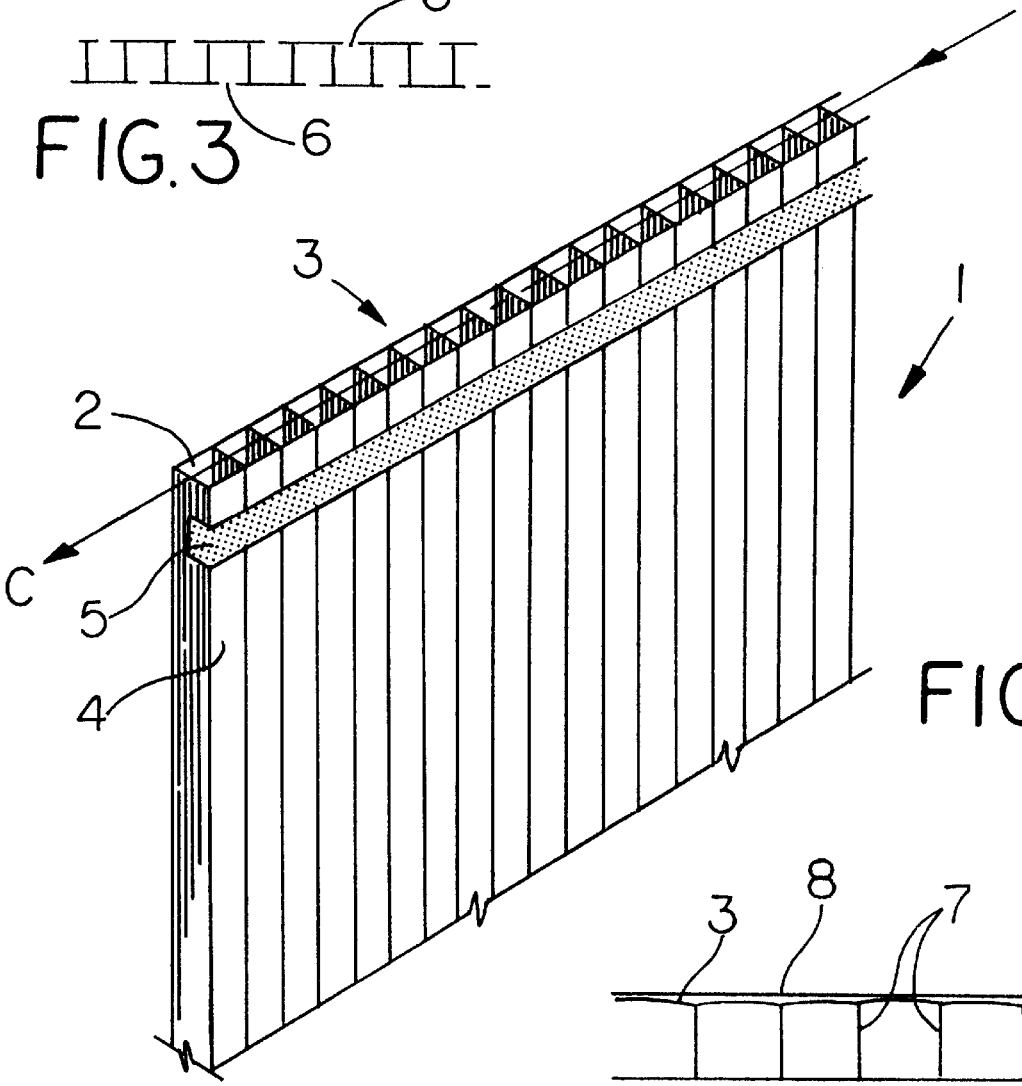

FIG. 4: shows a perspective view of the corrugated or fluted sheet materials.

Figure 5:
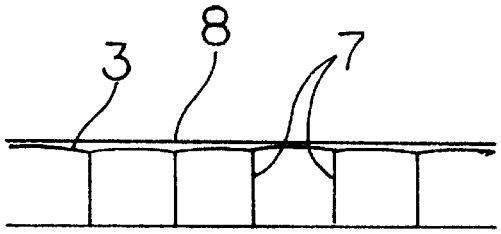

FIG. 5: shows a cross-sectional view of the display means wherein no channels have been cut having a print or image substrate mounted on the display side.

Figure 6:
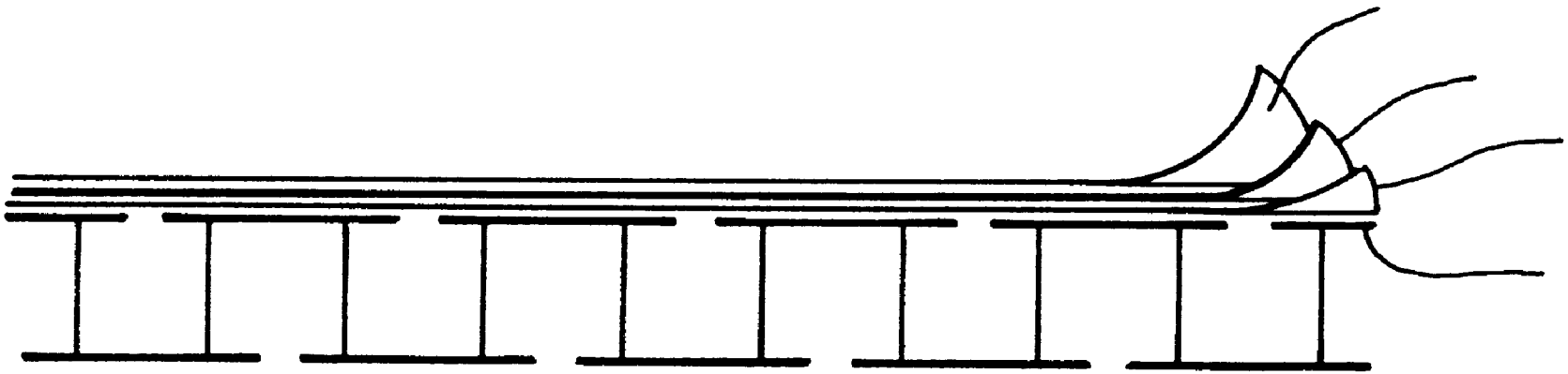

FIG. 6: shows a cross-sectional view of the display means wherein channels are cut in every second corrugation or flute on both surfaces having a print or image substrate mounted on the display surface.

Figure 7:
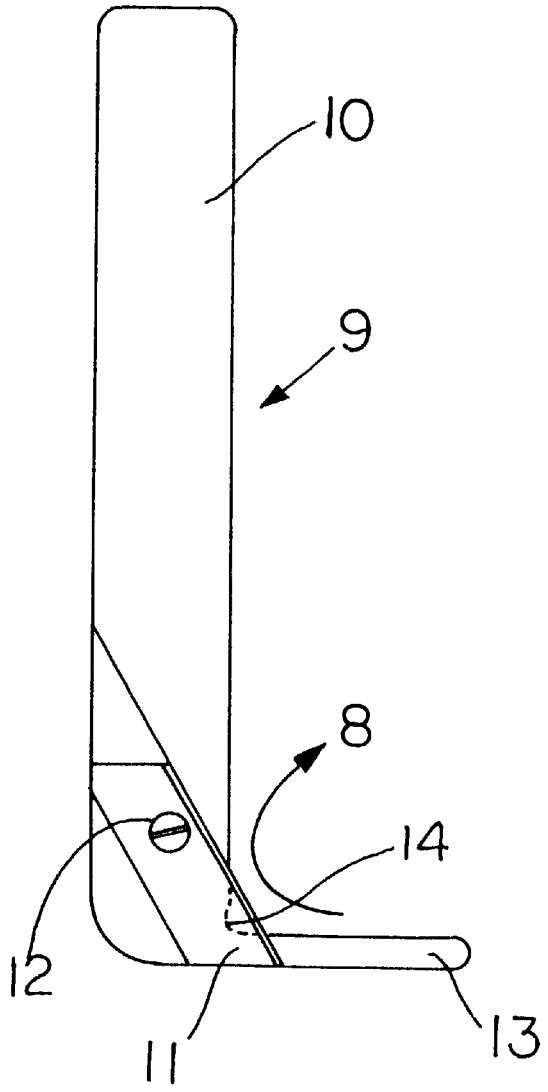

FIG. 7: shows a side view of a possible embodiment of the cutting tool.

Figure 8:
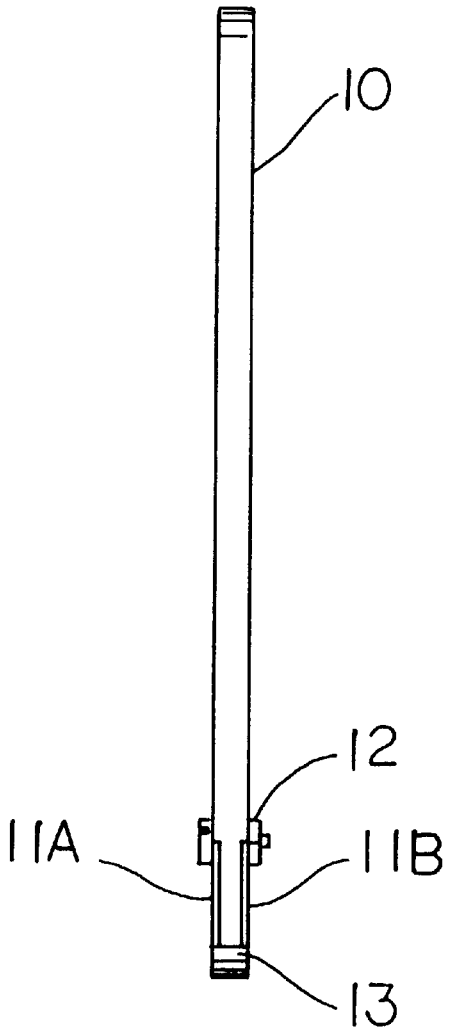

FIG. 8: shows an end view of the cutting tool of FIG. 7.

Figure 9:
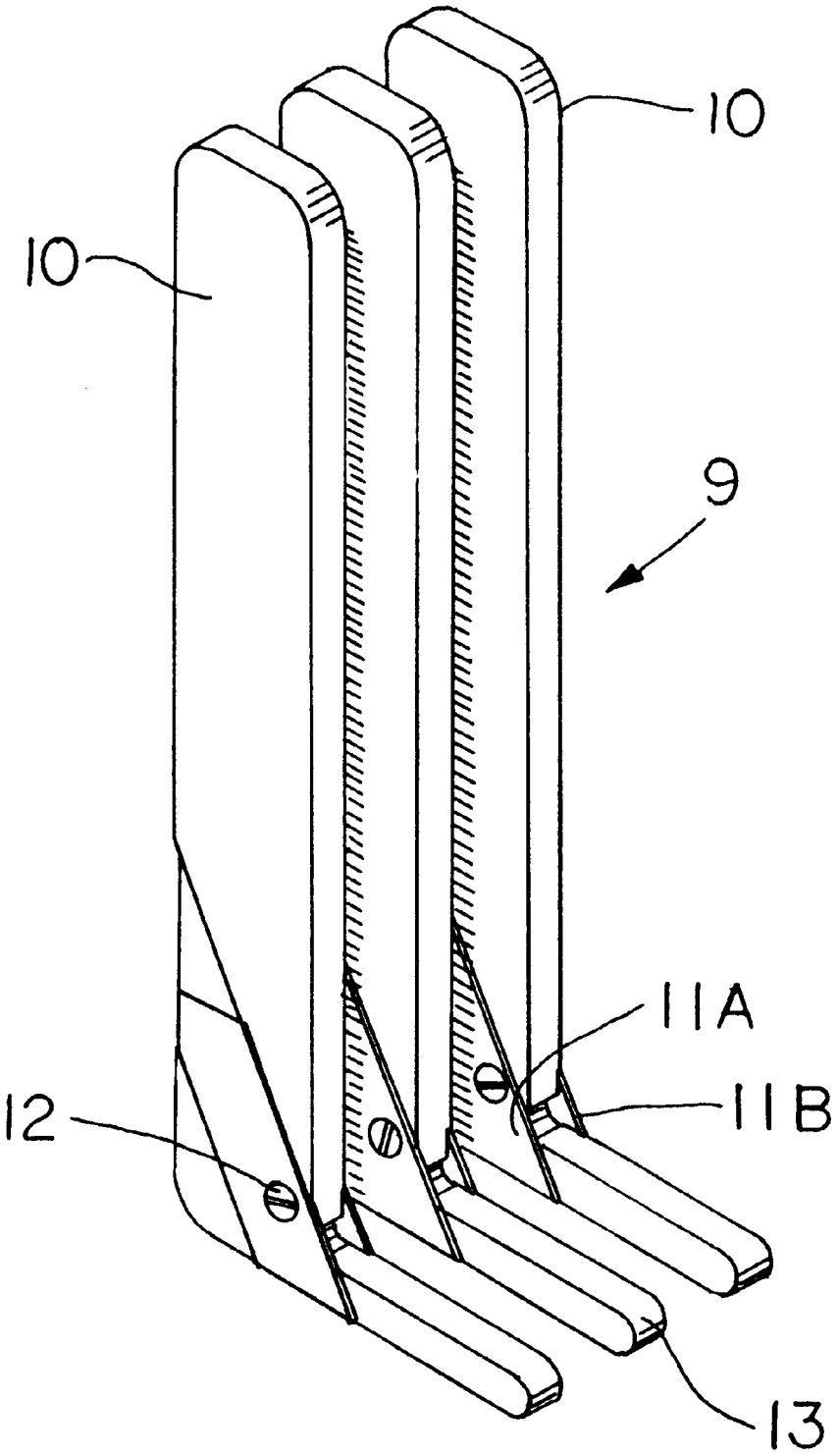

FIG. 9: shows a side perspective view of a possible embodiment of the cutting tool in which six cutting blades are mounted in parallel.

The present invention relates to display means and a method of forming or otherwise cutting the display means which in one embodiment thereof is particularly suitable for use in sheet type display means for promotional and advertising purposes. However, it is to be appreciated that the present invention has applications wherever the varied and efficient direction of display materials is required whether for temporary or permanent purposes.

It will also be appreciated that the present invention is adapted for the display of a variety of types of display means. For the purposes of this specification, such means may be described as various types of sheet-like material which include photographic materials, laminated photographic materials, self-screen materials, off-set printed materials and other image substrates.

While reference is made to "sheet materials", it will be appreciated that such materials may be retained in a substantially planar form or other embodiments formed into any possible shaped form, for example a tubular column. Such shaped forms may be achieved for example by means of a template allowing varied and efficient display purposes.

Likewise, the panel means of the present invention may comprise a deformable sheet material adapted for use in modelling, building or construction, for example, in creating shaped or contoured formations. Accordingly, the panels may be used as a die or mould, for example, in forming concrete or plastic structures or in a permanent structure of a desired shape.

Referring firstly to FIG. 4, a corrugated or fluted sheet material is referenced by 1, which shows a plurality of corrugations or flutes 2, it is seen that such flutes run parallel one to the other. The sheet material comprises a continuous display surface 3 and a support surface 4. It will be appreciated that in the FIG. 4 embodiment, the support surface is continuous rather than non-continuous as required in the invention. The sheet material has a layer of fastening means such as VELCRO® (hook and loop fasteners) 5 which is shown to be inserted in a channel in the support surface 4, so as to be flush with the said surface. Surface 4 may be used to secure the sheet material to either another sheet of material or like securement means. In this way, the sheet material may be maintained in a rigid state for display purposes.

FIG. 1 shows a cross-sectional end view of the sheet material. Display surface 3 is to be shown to be substantially continuous while support surface 4 is shown to be non-continuous, having a plurality of cut-outs or slits 6. In the embodiment, each corrugation or flute has a cut or slit in the rear surface.

In the case of FIG. 2, it is seen that the cuts or slits 6 are in every second corrugation or flute.

It will be appreciated that the FIG. 1 and FIG. 2 embodiments are simply two examples of how the support surface may be cut. It will be seen that a cut or slit may be placed in every third or fourth corrugation, or for that matter, whichever corrugation is required, whether those corrugations be on one or other or both surfaces.

In the case of FIG. 3, it will be seen that the cuts or slits 6 are in every second corrugation or flute on both surfaces, the continuous sheet being maintained by alternating the cuts on either surface.

By making the aforesaid cuts or slits in either one or both surfaces, the surface tension of the surfaces is reduced. Accordingly the sheet material may be rolled in the direction of A in FIG. 2 or in either direction in FIG. 3.

The cut-out s or slits may range in the case of relatively small display mean from approximately 0.1 mm to 2 mm each. In the case of larger panels the slits may themselves be larger. The width of the cut-out or slit will vary depending on the degree to which the sheet material needs to be rolled. Obviously, if it is to be desirable to roll the sheet material into a column for storage, the slits will need to be relatively wide. If on the other hand, it is only necessary for the sheet material to be rendered into an arcuate shape, then very narrow slits only will be required.

In the case of corrugated or fluted sheet material, indentations in both the rear support surface and display surface 3 occurs. This is shown in FIG. 5. In the case of display materials, such as off-set printing paper, these materials will show up the said indentation. This results in an unsatisfactory appearance in the display material. To avoid this difficulty, an adhesive or carrier sheet coated on both sides with adhesive may for example be applied to the display surface 3 and thereafter a print 8 stuck to the display surface. It will be appreciated that the FIG. 4 embodiment might be adapted for a variety of types of display mediums, such mediums including photographic materials, laminated photographic materials, self-screen materials, off-set printed materials and other image substrates.

FIG. 6 shows the print or image substrate 8 covered by a layer of plastic laminate 9, adhering to a carrier sheet coated on both sides with adhesive 10, which in turn is applied to the display surface of the display means 3.

In order to place the cuts or slits 6 in the support surface, a cutting tool is required. FIGS. 7 and 8 show such a tool for cutting a single slit or cut. The cutting tool 15 has a handle 10, blade 11, adjustment means 12 and guide means 13.

FIG. 9 is a side perspective view of a further possible embodiment of the cutting tool with three guide means 13. Each guide means can be seen to have two cutting blades 11*a* and 11*b* positioned either side, parallel to each other and rearwardly adjacent to guide means 13.

In this embodiment the handle is integrally formed with and positioned substantially perpendicular to the guide means 13. Blade means 11*a* and 11*b* attached to cutting tool 15 by way of nut and bolt as shown in FIGS. 7 and 8.

In use, the guide means 13 may be placed in any one flute or corrugation. The cutting tool may then be drawn towards the user. The two blades 11(*a*) and 11(*b*) would then cut a channel in the support surface of the display material. Any number of slits or channels could then be cut out of either or both of the surfaces of the display means.

It will be appreciated that a cutting tool 15 having a plurality of blade means may be provided. FIG. 9 is a side perspective view of a cutting tool means with six blade means. Such cutting tools with multiple blades would allow a plurality of slits or cuts to be made simultaneously in the support surface of the display material, by placing the guide means 13 in the equivalent number of flutes or corrugations and drawing the cutting tool towards the user.

In a preferred method of operation, the corrugated or fluted sheet material may be placed horizontally on a table or vertically on a support, and the cutting tool 15 may then be applied to the upward facing surface of the sheet material.

When required, the blades 11 may be removed and replaced.

In the preferred embodiment according to FIGS. 7, 8 and 9 the cutting tool has behind the leading edge of the blades a curved or arcuate recess (14) such that when in use cut sheet material is caused to spiral up in the direction of arrow B. In this way clogging of the cutting tool is minimised. The cutting tool means may be used continuously and the cut material may be disposed of in any suitable way.

It will be appreciated that the cutting tool may be mechanised and be operated by any mechanised or automated machine, whereby blades are run across the sheet material to provide the necessary slits or channels.

It should also be appreciated that while the present invention has been described in various embodiments as modifying an existing corrugated or fluted sheet material, the invention is not restricted to this in any way.

It will be appreciated that corrugated or fluted material of the type described may be manufactured or formed from the outset with the preformed slits. In this case, the cutting of slits or channels might not be required.

Lastly, it should be appreciated that suitable sheet material may be formed by cutting corrugated or flute sheet material in half along the line C of FIG. 4. In this way, essentially two usable sheets of material will be provided. Such a process may be more complicated if cutting needs to take place, but if it is formed in the first place, then the process will be simplified.

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the scope or spirit of the invention as defined in the appended claims.

I claim:

1. A display means comprising fluted sheet material comprising a display surface, a support surface spaced from said display surface, and with plurality of substantially flat and parallel spacer sheets extending between and connected to the display and support surfaces to define a plurality of flutes therebetween, wherein at least one of the display and support surfaces have a plurality of cut-outs defined by parallel edges provided in only one direction, said direction being substantially along the respective longitudinal axes of said flutes and each cut-out located between spacer sheets to divide said at least one surface into a plurality of flat parallel sections so as to enable said display means to be rollable in a direction transverse to said flutes, said at least one of the display and support surfaces remaining substantially continuously parallel to said other of said at least one of the display and support sheets and wherein the other of said at least one of the display and support sheets extending as a continuous surface between the spacer sheets on opposite sides of the cutouts.

2. A display means according to claim 1 wherein the cut-outs are provided in selected flutes on both surfaces of the said display means such that the cut-outs are alternated on either surface.

3. A display means as claimed in claim 1 wherein said cut-out comprise two parallel cuts in each of said selected flutes such that a strip of materials between said cuts is removed from said surfaces of said display means within each flute.

4. A display means according to claim 1 wherein the said cut-outs have a width ranging from 0.1 mm to 2 mm.

5. A display means according to claim 1, claim 2 or claim 3 in which a width of the cut-outs on one or both surfaces is varied to control a degree to which the sheet material may be rolled.

6. A display means according to claim 1, wherein said cut-outs release the pre-existing surface tension in said support surface of said fluted sheet material.

7. A display means as claimed in claim 1 wherein an adhesive means in applied to the display surface and thereafter an image substrate is adhered to the display surface.

8. A display means according to claim 7 in which said adhesive means comprises a carrier sheet coated on both sides with adhesive which is applied to the display surface.

9. A display according to claim 8 in which the image substrate comprises a laminated material in which a grain of the said laminated material is substantially at right angles to the slits in the display means.

10. A display means comprising fluted sheet material having a display surface, a support surface, and a plurality of flutes therebetween wherein at least one of the display and support surfaces have a plurality of cut-outs defined by parallel cuts provided in only one direction, said direction being substantially along the respective longitudinal axes of said flutes so as to enable said display means to be rollable in a direction transverse to said flutes and substantially rigid in said one direction, said at least one of the display and support surfaces having a pair of opposed edges, said cut-outs extending across only one of said at least one of the display and support surfaces between said edges, said at least one of the display and support surfaces remaining substantially continuous parallel to and between said cut-outs.

* * * * *